US008317539B2

(12) United States Patent
Stein

(10) Patent No.: US 8,317,539 B2
(45) Date of Patent: Nov. 27, 2012

(54) COAXIAL INTERCONNECT AND CONTACT

(75) Inventor: Casey Roy Stein, Surprise, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/853,723

(22) Filed: Aug. 10, 2010

(65) Prior Publication Data

US 2011/0039448 A1 Feb. 17, 2011

Related U.S. Application Data

(60) Provisional application No. 61/233,979, filed on Aug. 14, 2009.

(51) Int. Cl.
*H01R 9/05* (2006.01)

(52) U.S. Cl. ..... 439/578

(58) Field of Classification Search ..... 439/578, 439/884, 582, 584, 852, 581, 723, 843, 851, 439/585, 247, 353, 675, 52, 638, 654
See application file for complete search history.

(56) References Cited

U.S. PATENT DOCUMENTS

| | | | | |
|---|---|---|---|---|
| 4,895,521 | A | 1/1990 | Grabbe | 439/63 |
| 4,925,403 | A | 5/1990 | Zorzy | 439/578 |
| 5,203,717 | A | 4/1993 | Beck et al. | 439/460 |
| 5,273,443 | A | 12/1993 | Frantz et al. | 439/595 |
| 5,295,683 | A | 3/1994 | Tate | 439/578 |
| 5,498,175 | A * | 3/1996 | Yeh et al. | 439/578 |
| 5,611,707 | A | 3/1997 | Meynier | 439/353 |
| 5,865,654 | A * | 2/1999 | Shimirak et al. | 439/852 |
| 5,890,926 | A | 4/1999 | Pauza et al. | 439/445 |
| 5,906,511 | A | 5/1999 | Bozzer et al. | 439/579 |
| 6,071,127 | A | 6/2000 | Acke et al. | 439/63 |
| 6,338,653 | B1 | 1/2002 | Jones et al. | 439/579 |
| 6,398,593 | B1 * | 6/2002 | Yeh | 439/723 |
| 6,547,593 | B1 | 4/2003 | Beckous | 439/581 |
| 6,692,262 | B1 | 2/2004 | Loveless | 439/63 |
| 6,827,608 | B2 | 12/2004 | Hall et al. | 439/578 |
| D595,653 | S * | 7/2009 | Di Stefano | D13/133 |
| 2004/0038586 | A1 | 2/2004 | Hall et al. | 439/578 |
| 2004/0092165 | A1 | 5/2004 | Holland | 439/607 |
| 2006/0051997 | A1 | 3/2006 | Kooiman | 439/180 |
| 2006/0084286 | A1 | 4/2006 | Kooiman | 439/63 |
| 2009/0264003 | A1 | 10/2009 | Hertzler et al. | 439/299 |
| 2011/0151714 | A1 | 6/2011 | Flaherty et al. | 439/578 |

FOREIGN PATENT DOCUMENTS

| | | |
|---|---|---|
| DE | 10202637 | 8/2003 |
| DE | 202008011118 | 10/2008 |
| DE | 202008011119 | 10/2008 |
| EP | 0582960 | 8/1993 |
| EP | 1207592 | 5/2002 |
| EP | 1434313 | 6/2004 |
| EP | 2051340 A1 | 4/2009 |
| WO | WO98/33243 | 7/1998 |

OTHER PUBLICATIONS

Patent Cooperation Treaty Form ISA/210, Jun. 29, 2011, pp. 1-2.

* cited by examiner

*Primary Examiner* — Alexander Gilman

(57) ABSTRACT

A coaxial interconnect and contact are provided. The coaxial contact is patterned to define a plurality of openings along its longitudinal length. An inner surface of the contact can circumferentially engage an outer surface of a mating contact, wherein such engagement causes at least a portion of the contact to flex radially outwardly. The contact can also flex in the longitudinal or axial direction.

22 Claims, 12 Drawing Sheets

COAXIAL INTERCONNECT AND CONTACT

CROSS-REFERENCE TO RELATED APPLICATIONS

This application claims the benefit of, and priority to U.S. Provisional Patent Application No. 61/233,979 filed on Aug. 14, 2009 entitled, "Coaxial Interconnect and Contact", the content of which is relied upon and incorporated herein by reference in its entirety.

BACKGROUND

The disclosure relates generally to electrical connectors, and particularly to coaxial connectors, and more particularly to coaxial connectors utilizing male and female interfaces for the interconnecting of boards, modules, and cables.

The technical field of coaxial connectors, including microwave frequency connectors, includes connectors designed to transmit electrical signals and/or power. Male and female interfaces can be engaged and disengaged to connect and disconnect the electrical signals and/or power.

These interfaces typically utilize socket contacts that are designed to engage pin contacts. These metallic contacts are generally surrounded by a plastic insulator with dielectric characteristics. A metallic housing surrounds the insulator to provide electrical grounding and isolation from electrical interference or noise. These connector assemblies can be coupled by various methods including a push-on design.

The dielectric properties of the plastic insulator along with its position between the contact and the housing produce an electrical impedance, such as 50 ohms Microwave or radio frequency (RF) systems with a matched electrical impedance are more power efficient and therefore capable of improved electrical performance.

DC connectors utilize a similar contact, insulator, and housing configuration. DC connectors do not required impedance matching. Mixed signal applications including DC and RF are common.

Connector assemblies can be coupled by various methods including a push-on design. The connector configuration can be a two piece system (male to female) or a three piece system (male to female-female to male). The three piece connector system utilizes a double ended female interface known as a blind-mate interconnect (BMI). The BMI includes a double ended socket contact, two or more insulators, and a metallic housing with grounding fingers. The three piece connector system also utilizes two male interfaces each with a pin contact, insulator, and metallic housing called a shroud. The insulator of the male interface is typically plastic or glass. The shroud can have a detent feature that engages the front fingers of the BMI metallic housing for mated retention. This detent feature can be modified thus resulting in high and low retention forces for various applications. The three piece connector system enables improved electrical and mechanical performance during radial and axial misalignment.

Socket contacts are a key component in the transmission of the electrical signal. Conventional socket contacts used in coaxial connectors, including microwave frequency connectors, typically utilize a straight or tapered beam design that requires time consuming traditional machining and forming techniques. Such contacts, upon engagement, typically result in a non-circular cross section, such as an oval, triangular, square or other simple geometric cross section, depending on the number of beams. These non-circular cross sections can result in degraded electrical performance. In addition, when exposed to forces that cause mated misalignment of pin contacts, conventional beam sockets tend to flare and can, therefore, degrade the contact points. In such instances, conventional beam sockets can also loose contact with some of the pin contacts or become distorted, causing damage to the beams or a degradation in RF performance.

SUMMARY

One embodiment includes a coaxial connector contact for connecting to a coaxial transmission medium to form an electrically conductive path between the transmission medium and the coaxial connector contact. The coaxial connector contact includes a main body that includes a proximal portion and a distal portion, a first end and an opposing second end. The first end is disposed on the proximal portion and the second end is disposed on the distal portion. Along the proximal portion, the main body includes electrically conductive material that extends circumferentially along a longitudinal axis, the electrically conductive material having an inner surface and an outer surface. The electrically conductive material is patterned to define a plurality of openings extending between the inner and outer surfaces along a longitudinal length of the proximal portion. At least one of the openings extends from the first end and at least one other of the openings does not extend to the first end.

Another embodiment includes a coaxial connector for connecting to a coaxial transmission medium to form an electrically conductive path between the transmission medium and the coaxial connector. The coaxial connector includes an outer conductor portion for electrically coupling to an outer conductor of the coaxial transmission medium. The outer conductor portion extends substantially circumferentially about a longitudinal axis and defines a first central bore. The coaxial connector also includes an insulator disposed within the first central bore and extending at least partially about the longitudinal axis and defining a second central bore. In addition, the coaxial connector includes a coaxial connector contact at least partially disposed within the second central bore. The coaxial connector contact includes a main body that includes a proximal portion and a distal portion, a first end and an opposing second end. The first end is disposed on the proximal portion and the second end is disposed on the distal portion. Along the proximal portion, the main body includes electrically conductive material that extends circumferentially along a longitudinal axis, the electrically conductive material having an inner surface and an outer surface. The electrically conductive material is patterned to define a plurality of openings extending between the inner and outer surfaces along a longitudinal length of the proximal portion. At least one of the openings extends from the first end and at least one other of the openings does not extend to the first end.

Yet another embodiment includes a coaxial transmission medium assembly. The assembly includes a coaxial transmission medium and a coaxial connector. The coaxial transmission medium includes a conductive outer housing extending circumferentially about a longitudinal axis. The coaxial transmission medium also includes an insulator circumferentially surrounded by the conductive outer housing. In addition, the coaxial transmission medium includes a conductive mating contact at least partially circumferentially surrounded by the insulator. The coaxial connector includes an outer conductor portion for electrically coupling to an outer conductor of the coaxial transmission medium. The outer conductor portion extends substantially circumferentially about a longitudinal axis and defines a first central bore. The coaxial connector also includes an insulator disposed within the first central bore and extending at least partially about the longitudinal axis and defining a second central bore. In addition, the coaxial connector includes a coaxial connector contact at least partially disposed within the second central bore. The coaxial connector contact includes a main body that includes a proximal portion and a distal portion, a first end and an opposing second end. The first end is disposed on the proximal portion and the second end is disposed on the distal portion. Along the proximal portion, the main body includes electrically conductive material that extends circumferentially along a longitudinal axis, the electrically conductive material having an inner surface and an outer surface. The electrically conductive material is patterned to define a plurality of openings extending between the inner and outer surfaces along a longitudinal length of the proximal portion. At least one of the openings extends from the first end and at least one other of the openings does not extend to the first end. The conductive outer housing of the coaxial transmission medium is electrically coupled to the outer conductor portion of the coaxial connector and the conductive mating contact of the coaxial transmission medium is electrically coupled to the coaxial connector contact.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description present exemplary embodiments, and are intended to provide an overview or framework for understanding the nature and character of the claims. The accompanying drawings are included to provide a further understanding, and are incorporated into and constitute a part of this specification. The drawings illustrate various embodiments, and together with the description serve to explain the principles and operations of the various embodiments.

DETAILED DESCRIPTION

Reference will now be made in detail to the present preferred embodiments, examples of which are illustrated in the accompanying drawings.

Figure 1:
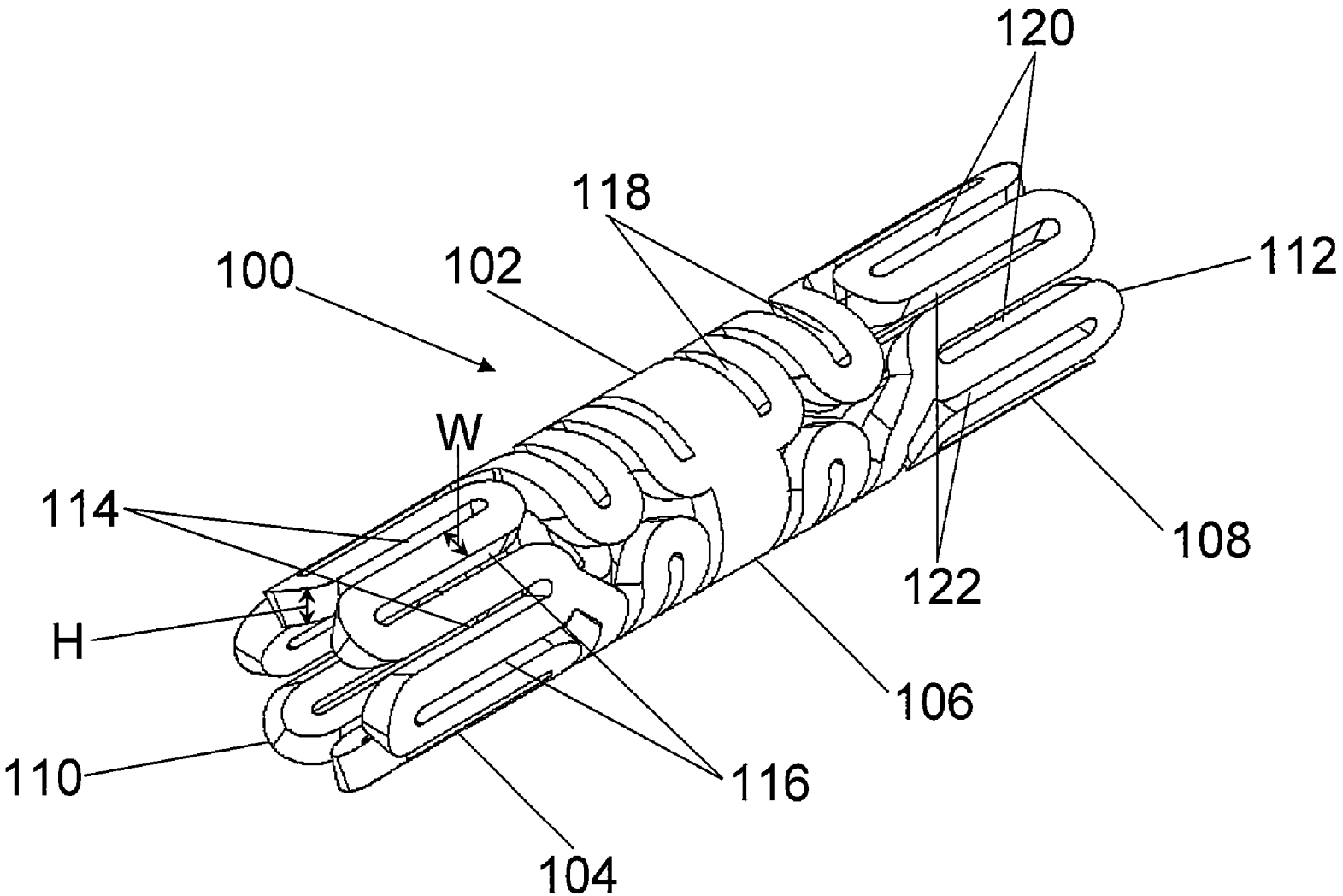
FIG. 1 illustrates a perspective view of an embodiment of a socket contact as disclosed herein.

FIG. 1 illustrates a perspective view of a socket contact 100 that includes a main body 102 extending along a longitudinal axis. The main body 102 has a proximal portion 104, a distal portion 108, and a central portion 106 that is axially between the proximal portion 104 and the distal portion 108, wherein each of the proximal portion 104, distal portion 108, and central portion 106, each have inner and outer surfaces. The main body 102 also has a first end 110 disposed on proximal portion 104 and an opposing second end 112 disposed on distal portion 108. Main body 102 is comprised of electrically conductive and mechanically resilient material having spring-like characteristics that extends circumferentially around the longitudinal axis. Preferred materials for main body 102 include gold plated beryllium copper (BeCu), stainless steel, or a cobalt-chromium-nickel-molybdenum-iron alloy such as Conichrome, Phynox, and Elgiloy. A particularly preferred material for main body 102 is gold plated beryllium copper (BeCu).

The electrically conductive and mechanically resilient material is patterned to define a plurality of openings in main body 102. At least a portion of the plurality of openings extend along a longitudinal length of proximal portion 104 between the inner and outer surfaces of proximal portion 104, wherein at least one of the openings 114 extends from first end 110 and at least one other of the openings 116 does not extend to first end 110. In the embodiment illustrated in FIG. 1, at least a portion of the plurality of openings also extend along a longitudinal length of distal portion 108 between the inner and outer surfaces of distal portion 108, wherein at least one of the openings 120 extends from second end 112 and at least one other of the openings 122 does not extend to second end 112. In the embodiment illustrated in FIG. 1, at least a portion 118 of the plurality of openings also extend at least partially circumferentially around central portion 106 between the inner and outer surfaces of central portion 106.

In the embodiment illustrated in FIG. 1, the openings extending along the longitudinal length of proximal portion 104 comprise first u-shaped slots. Specifically, openings 114 extending from first end 110 and openings 116 not extending to first end 110 comprise first u-shaped slots. Openings 118 extending at least partially circumferentially around central portion 106 comprise second u-shaped slots. Second u-shaped slots are generally perpendicular to first u-shaped slots. Openings extending along the longitudinal length of distal portion 108 comprise third u-shaped slots. Specifically, openings 120 extending from second end 112 and openings 122 not extending to second end 112 comprise third u-shaped slots.

As shown in FIG. 1, along the proximal portion 104 and distal portion 108, the u-shaped slots alternate in opposing orientations such that, along the proximal portion 104 and distal portion 108, the electrically conductive and mechanically resilient material circumferentially extends around the longitudinal axis in an axially parallel accordion pattern. The radially outermost portion of electrically conductive and mechanically resilient material has a width, W, that in preferred embodiments, is approximately constant along different portions of the axially parallel accordion pattern. Additionally, the radially outermost portion of electrically conductive and mechanically resilient material has a height, H. In preferred embodiments, height H is approximately constant along different portions of the pattern. Preferably, the ratio of H/W is from about 0.5 to about 2.0, such as from about 0.75 to about 1.5, including about 1.0.

Preferably, main body 102 is of unitary construction. In a preferred embodiment, main body 102 is constructed from a thin-walled cylindrical tube of electrically conductive and mechanically resilient material, wherein patterns, such as the patterns illustrated in FIG. 1, have been cut into the tube, such that the patterns define a plurality of openings that extend between the inner and outer surfaces of the tube. The thin wall tube can be fabricated to small sizes (for applications where size and weight are of importance) by various methods including extruding, drawing, and deep drawing. The patterns can be laser machined, stamped, etched, electrical discharge machined (EDM'd) or traditionally machined into the tube depending on the feature size. In particularly preferred embodiments, the patterns are laser machined into the tube.

Figure 2:
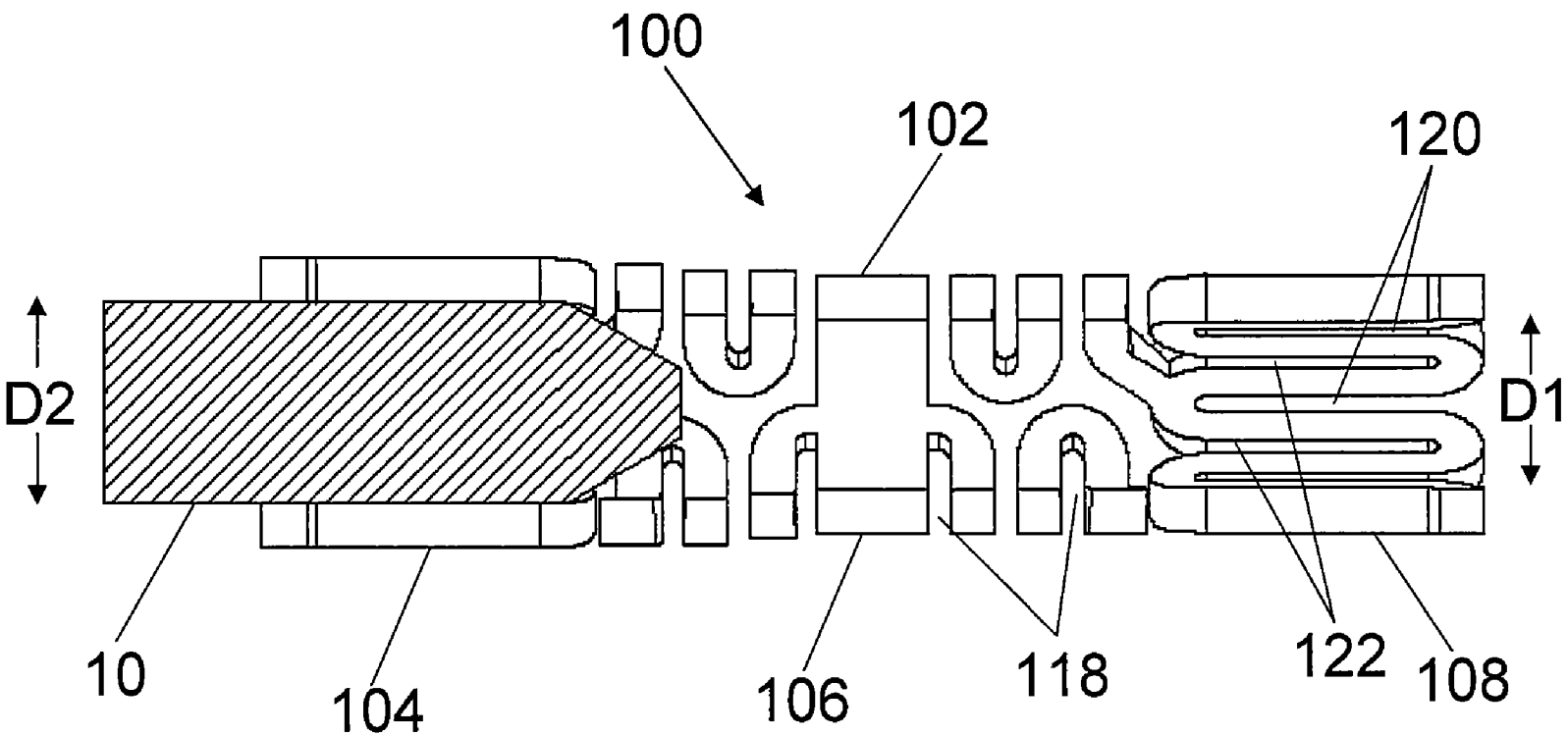
FIG. 2 illustrates a side cutaway view of the socket contact illustrated in FIG. 1, wherein the socket is shown engaging a male pin contact.

FIG. 2 illustrates a side cutaway view of the socket contact 100 illustrated in FIG. 1, wherein the socket is shown engaging a mating (male pin) contact 10. An inner surface of proximal portion 104 and an inner surface of distal portion 108 are each adapted to circumferentially engage an outer surface of mating contact 10. Prior to engagement with mating contact 10, proximal portion 104 and distal portion 108 each have an inner diameter D1 that is smaller than an outer diameter D2 of mating contact 10. Engagement of the inner surface of proximal portion 104 or distal portion 108 with outer surface of mating contact 10 causes proximal portion 104 and/or distal portion 108 to flex radially outwardly such that, during such engagement, inner diameter of proximal portion 104 and/or distal portion 108 is at least equal to D2, as is illustrated in FIG. 2 where inner diameter of proximal portion 104 is approximately equal to D2 upon engagement with mating contact 10 whereas distal portion 108 is not engaged to a mating contact and has an inner diameter of D1. Disengagement of the inner surface of proximal portion 104 and/or distal portion 108 with the outer surface of mating contact 10 causes inner diameter of proximal portion 104 and/or distal portion 108 to return to D1. While not limited, D2/D1 is preferably at least 1.05, such as at least 1.1, and further such as at least 1.2, and yet further such as at least 1.3. The outward radial flexing of proximal portion 104 and/or distal portion 108 during engagement with mating contact 10 results in a radially inward biasing force of socket contact 100 on mating contact 10, thereby facilitating transmission of an electrical signal between the socket contact 100 and the mating contact 10 and also reducing the possibility of unwanted disengagement between the socket contact 100 and the mating contact 10.

In preferred embodiments, the entire inner surface of proximal portion 104 and the entire inner surface of distal portion 108 are adapted to contact the outer cylindrical surface of mating contact 10 upon full engagement with mating contact 10. Preferably, proximal portion 104 and distal portion 108 each have a circular or approximately circular shaped cross-section of uniform or approximately uniform inner diameter of D1 along their longitudinal lengths prior to or subsequent to engagement with mating contact 10 and proximal portion 104 and distal portion 108 each have a circular or approximately circular shaped cross-section of uniform or approximately uniform inner diameter of at least D2 along their longitudinal lengths during engagement with mating contact 10. Put another way, the area bounded by inner surface of proximal portion 104 and the area bounded by inner surface of distal portion 108 each preferably approximates that of a cylinder having a diameter of D1 prior to or subsequent to engagement with mating contact 10 and the area bounded by inner surface of proximal portion 104 and the area bounded by inner surface of distal portion 108 each preferably approximates that of a cylinder having a diameter of D2 during engagement with mating contact 10.

Figure 3:
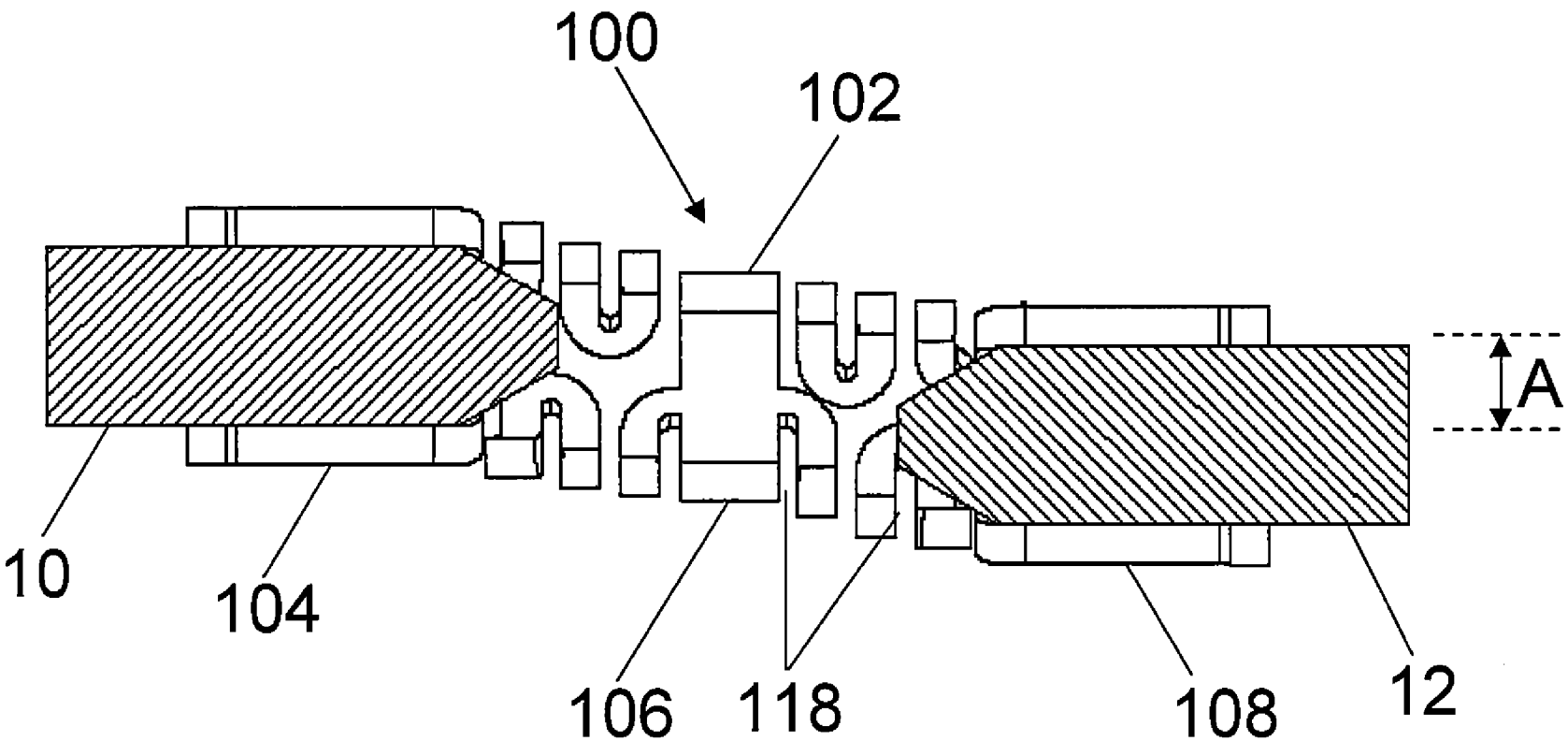
FIG. 3 illustrates a side cutaway view of the socket contact illustrated in FIG. 1, wherein the socket is shown engaging two non-coaxial male pin contacts.

FIG. 3 illustrates a side cutaway view of the socket contact 100 illustrated in FIG. 1, wherein the socket is shown engaging two mating (male pin) contacts 10 and 12. As shown in FIG. 3, mating contact 10 is circumferentially engaged by proximal portion 104 and mating contact 12 is circumferentially engaged by distal portion 108. Mating contact 10 is not coaxial with mating contact 12 and the amount of offset (or mated misalignment) between the longitudinal axis of mating contact 10 and the longitudinal axis of mating contact 12 is indicated by the distance A.

As illustrated in FIG. 3, socket contact 100 is adapted to flex axially along central portion 106, thereby allowing for mating misalignment (gimballing) between mating contact 10 and mating contact 12 while still maintaining radially inward biasing force of socket contact 100 on mating contacts 10 and 12, thereby facilitating transmission of an electrical signal between the socket contact 100 and the mating contacts 10 and 12 and also reducing the possibility of unwanted disengagement between the socket contact 100 and the mating contacts 10 and 12 during mated misalignment.

In preferred embodiments, when mating contact 10 is not coaxial with mating contact 12, the entire inner surface of proximal portion 104 and the entire inner surface of distal portion 108 are adapted to contact the outer cylindrical surface of mating contacts 10 and 12 upon full engagement with mating contacts 10 and 12. Preferably, proximal portion 104 and distal portion 108 each have a circular or approximately circular shaped cross-section of uniform or approximately uniform inner diameter of D1 along their longitudinal lengths prior to or subsequent to engagement with mating contacts 10 and 12 and proximal portion 104 and distal portion 108 each have a circular or approximately circular shaped cross-section of uniform or approximately uniform inner diameter of at least D2 along their longitudinal lengths during engagement with mating contacts 10 and 12. Put another way, the area bounded by inner surface of proximal portion 104 and the area bounded by inner surface of distal portion 108 each preferably approximates that of a cylinder having a diameter of D1 prior to or subsequent to engagement with mating contacts 10 and 12 and the area bounded by inner surface of proximal portion 104 and the area bounded by inner surface of distal portion 108 each preferably approximates that of a cylinder having a diameter of D2 during engagement with mating contacts 10 and 12. Preferably, socket contact 100 is adapted to allow for A/D1 to be at least about 0.4, such as at least about 0.6, and further such as at least about 1.2. Preferably, socket contact 100 is adapted to allow for A/D2 to be at least about 0.3, such as at least about 0.5, and further such as at least about 1.0. Preferably, socket contact 100 is adapted to allow for the longitudinal axis of mating contact 10 to be substantially parallel to the longitudinal axis of mating contact 12 when mating contacts 10 and 12 are not coaxial, such as when A/D2 is at least about 0.3, such as at least about 0.5, and further such as at least about 1.0.

Figure 4:
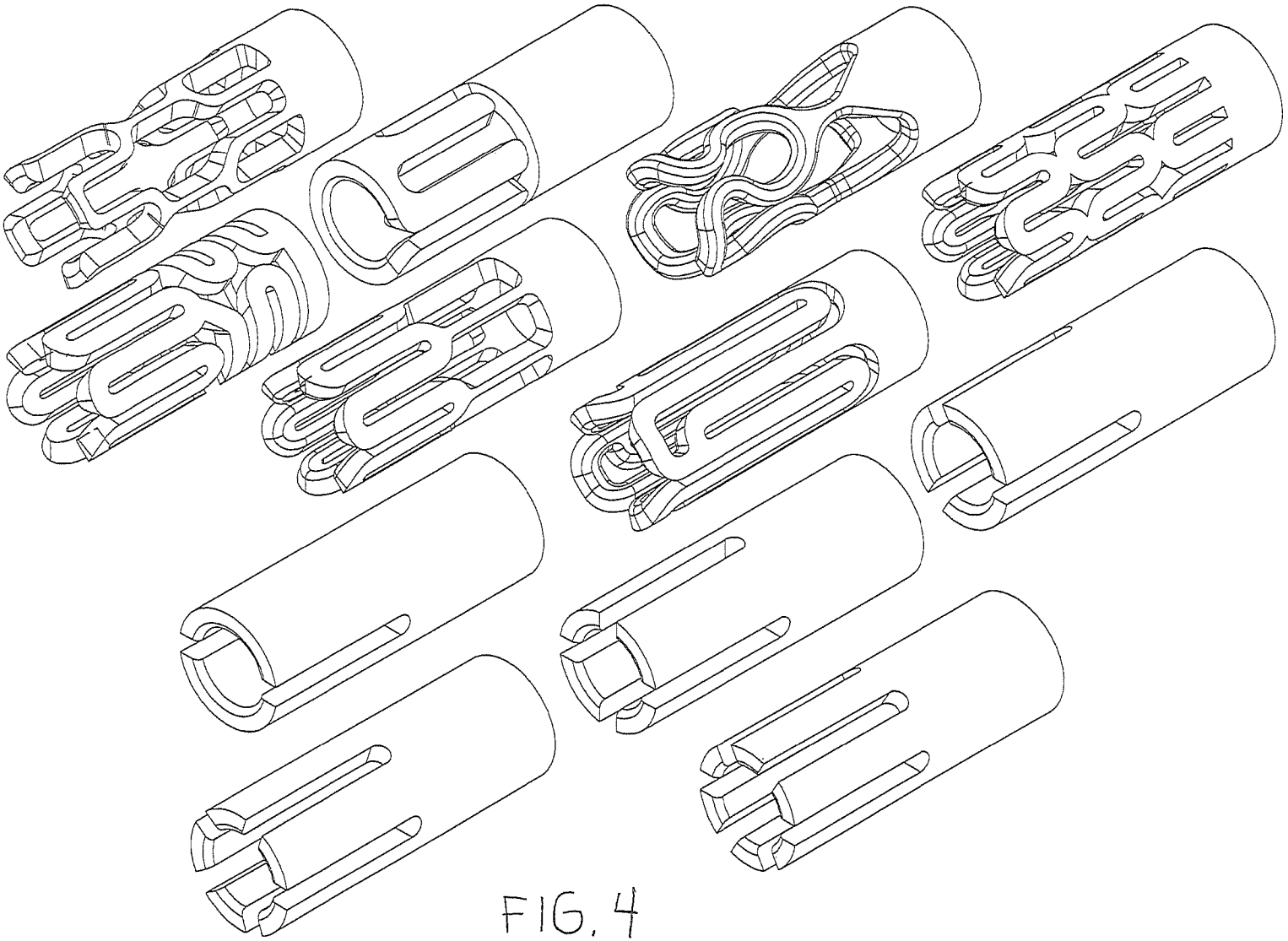
FIG. 4 illustrates perspective views of alternate embodiments of socket contacts as disclosed herein.

FIG. 4 illustrates perspective views of alternate embodiments of socket contacts as disclosed herein. Such embodiments include single ended variations wherein the proximal portion of the socket is adapted to engage a pin contact and the distal portion of the socket can be soldered or brazed to a wire or soldered, brazed, or welded to another contact, such as another socket/pin configuration. As with the socket contact illustrated in FIGS. 1-3, socket contacts illustrated in FIG. 4 can be adapted to flex radially and axially along at least a portion of their longitudinal length. The patterns on socket contacts illustrated in FIG. 4 can also be double ended, similar to the socket contact illustrated in FIGS. 1-3.

Figure 5:
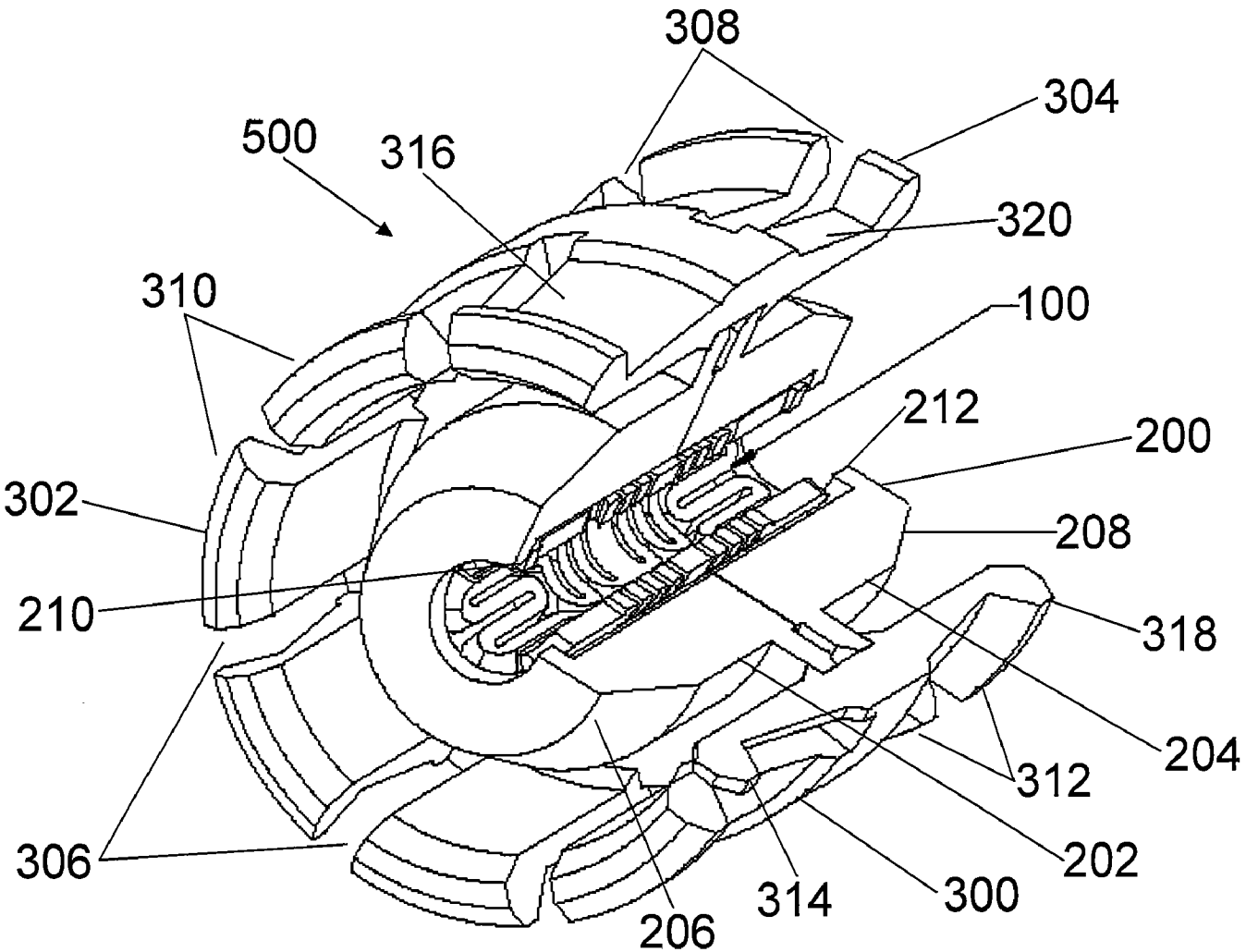
FIG. 5 illustrates a perspective view of an embodiment of a coaxial connector as disclosed herein.

FIG. 5 illustrates a perspective view of an embodiment of a coaxial connector 500 as disclosed herein. Coaxial connector 500 defines a blind mate interconnect (BMI) that includes outer conductor portion 300, insulator 200, and socket contact 100 illustrated in FIGS. 1-3. Outer conductor portion 300 extends substantially circumferentially about a longitudinal axis and defines a first central bore. Insulator 200 is disposed within the first central bore and extends about longitudinal axis. Insulator 200 includes first insulator component 202 and second insulator component 204 and defines a second central bore. Socket contact 100 is disposed within second central bore.

Outer conductor portion 300 has a proximal end 302 and a distal end 304. A plurality of first slots 306 extend substantially along a longitudinal direction from the proximal end, and a plurality of second slots 308 extend substantially along a longitudinal direction from the distal end to define a plurality of first cantilevered beams 310 and a plurality of second cantilevered beams 312, wherein the plurality of first cantilevered beams 310 extend substantially circumferentially around proximal end 302 and the plurality of second cantilevered beams 312 extend substantially circumferentially around distal end 304. Each of plurality of first cantilevered beams 310 includes an external detent feature 314 and a tapering region 316 and each of plurality of second cantilevered beams 312 includes an external detent feature 318 and a tapering region 320. Cantilevered beams 310 and 312 are designed to deflect radially inwardly as they engage an inside surface of a conductive outer housing of a coaxial transmission medium (see, e.g., FIG. 6), thereby providing a biasing force for facilitating proper grounding. In the embodiment illustrated in FIG. 5, slots 306 are offset relative to slots 308 in order to minimize mechanical stress on cantilevered beams 310 and 312 during mating. In other preferred embodiments, slots 306 and 308 could be configured to overlap (not shown).

Figure 6:
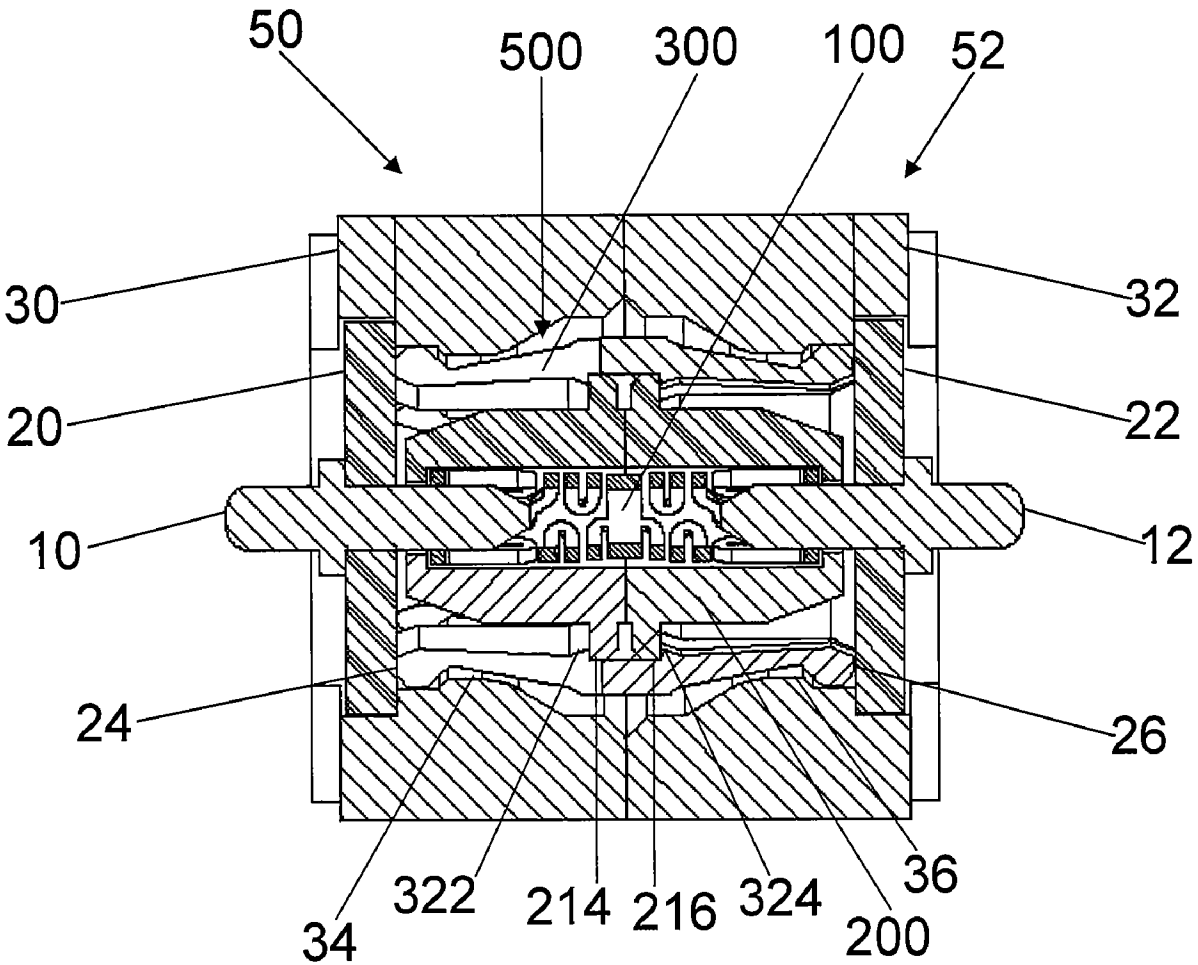
FIG. 6 illustrates a side cutaway view of the connector illustrated in FIG. 5 engaged with two male connectors.

First insulator component 202 includes tapered outer surface 206 and reduced diameter portion 210. Second insulator component 204 includes tapered outer surface 208 and reduced diameter portion 212. Tapered outer surfaces 206 and 208 facilitate access for a mating/de-mating tool (see, e.g., FIG. 8). Reduced diameter portions 210 and 212 allow insulator 200 to retain socket contact 100. In addition, reduced diameter portions 210 and 212 provide a lead in feature for mating contacts 10 and 12 (see, e.g., FIG. 6) to facilitate engagement between socket contact 100 and mating contacts 10 and 12. As shown in FIG. 6, first insulator component 202 additionally includes increased diameter portion 214 and second insulator component 204 also includes increased diameter portion 216, wherein increased diameter portion 214 has a ramped outer surface that faces a ramped outer surface on increased diameter portion 216. Outer conductor portion 300 includes first inner ramped feature 322 and second inner ramped feature 324.

Preferably, each of first and second insulator components 202 and 204 are retained in outer conductor portion 300 by first being slid longitudinally from the respective proximal 302 or distal end 304 of outer conductor portion 300 toward the center of outer conductor portion 300. As increased diameter portions 214 and 216 slide past first and second inner ramped features 322 and 324, increased diameter portions 214 and 216 are momentarily compressed radially inward. After sliding past first and second inner ramped features 322 and 324, increased diameter portions 214 and 216 recover to their original dimensions and are thereby retained by outer conductor portion 300 as a result of engagement between increased diameter portions 214 and 216 and first and second inner ramped features 322 and 324.

Outer conductor portion 300 is preferably made of a mechanically resilient electrically conductive material having spring-like characteristics, such as a mechanically resilient metal or metal alloy. A preferred material for the outer conductor portion 300 is beryllium copper (BeCu), which may optionally be plated over with another material, such as nickel and/or gold. Insulator 200, including first insulator component 202 and second insulator component 204, is preferably made from a plastic or dielectric material. Preferred materials for insulator 200 include Torlon® (polyamide-imide), Vespel® (polyimide), and Ultem (Polyetherimide). This dielectric may be machined or molded but preferably molded. The dielectric characteristics of the insulators 202 and 204 along with their position between socket contact 100 and outer conductor portion 300 produce an electrical impedance, such as 50 ohms Fine tuning of the electrical impedance can be accomplished by changes to the size and/or shape of the socket contact 100, insulator 200, and/or outer conductor portion 300.

FIG. 6 illustrates a side cutaway view of coaxial connector 500 illustrated in FIG. 5 engaged with two male connectors 50 and 52. Male connector 50 acts as a coaxial transmission medium and includes a conductive outer housing (or shroud) 30 extending circumferentially about a longitudinal axis, an insulator 20 circumferentially surrounded by the conductive outer housing 30, and a conductive mating contact (male pin) 10 at least partially circumferentially surrounded by insulator 20. Male connector 52 also acts as a coaxial transmission medium and includes a conductive outer housing (or shroud) 32 extending circumferentially about a longitudinal axis, an insulator 22 circumferentially surrounded by the conductive outer housing 32, and a conductive mating contact (male pin) 12 at least partially circumferentially surrounded by insulator 22.

In the embodiment illustrated in FIG. 6, conductive outer housings 30 and 32 are electrically coupled to outer conductor portion 300 and mating contacts 10 and 12 are electrically coupled to socket contact 100. Cantilevered beams 310 and 312 deflect radially inwardly as they engage an inside surface of a conductive outer housings 30 and 32, thereby providing a biasing force for facilitating proper grounding. Inner surfaces 24 and 26 of insulators 20 and 22 act as a mechanical stop or reference plane for first and second cantilevered beams 310 and 312 of outer conductor portion 300. Conductive outer housings 30 and 32 each include detent features 34 and 36, respectively. Detent features 34 and 36 are each respectively configured to engage external detent features 314 and 318 of first and second cantilevered beams 310 and 312 of outer conductor portion 300 to facilitate mated retention between coaxial connector 500 and male connectors 50 and 52. Depending on the application, the geometry of the detent features 34 and 36 can be modified to provide a predetermined amount of retention force between coaxial connector 500 and male connectors 50 and 52.

Central bore of insulator 200 is adapted to allow proximal and distal portions 104 and 108 of socket contact 100 to flex radially outwardly upon engagement with mating contacts 10 and 12. In preferred embodiments, the entire inner surface of proximal portion 104 and the entire inner surface of distal portion 108 of socket contact 100 are adapted to contact the outer cylindrical surface of mating contacts 10 and 12 upon full engagement with mating contacts 10 and 12.

Conductive outer housings 30 and 32 are each preferably made of an electrically conductive material, such as a metal or metal alloy. Preferred materials for conductive outer housings 30 and 32 include beryllium copper (BeCu) and Kovar®, which may optionally be plated over with another material, such as nickel and/or gold. Insulators 20 and 22 can be made from any electrically insulative material, such as plastic or glass. A preferred material for insulators 20 and 22 is Torlon® (polyamide-imide). Optionally, air can functionally act as insulators 20 and 22. Mating contacts 10 and 12 are each preferably made of an electrically conductive material, such as a metal or metal alloy. A preferred material for mating contacts 10 and 12 is gold plated beryllium copper (BeCu).

Figure 7:
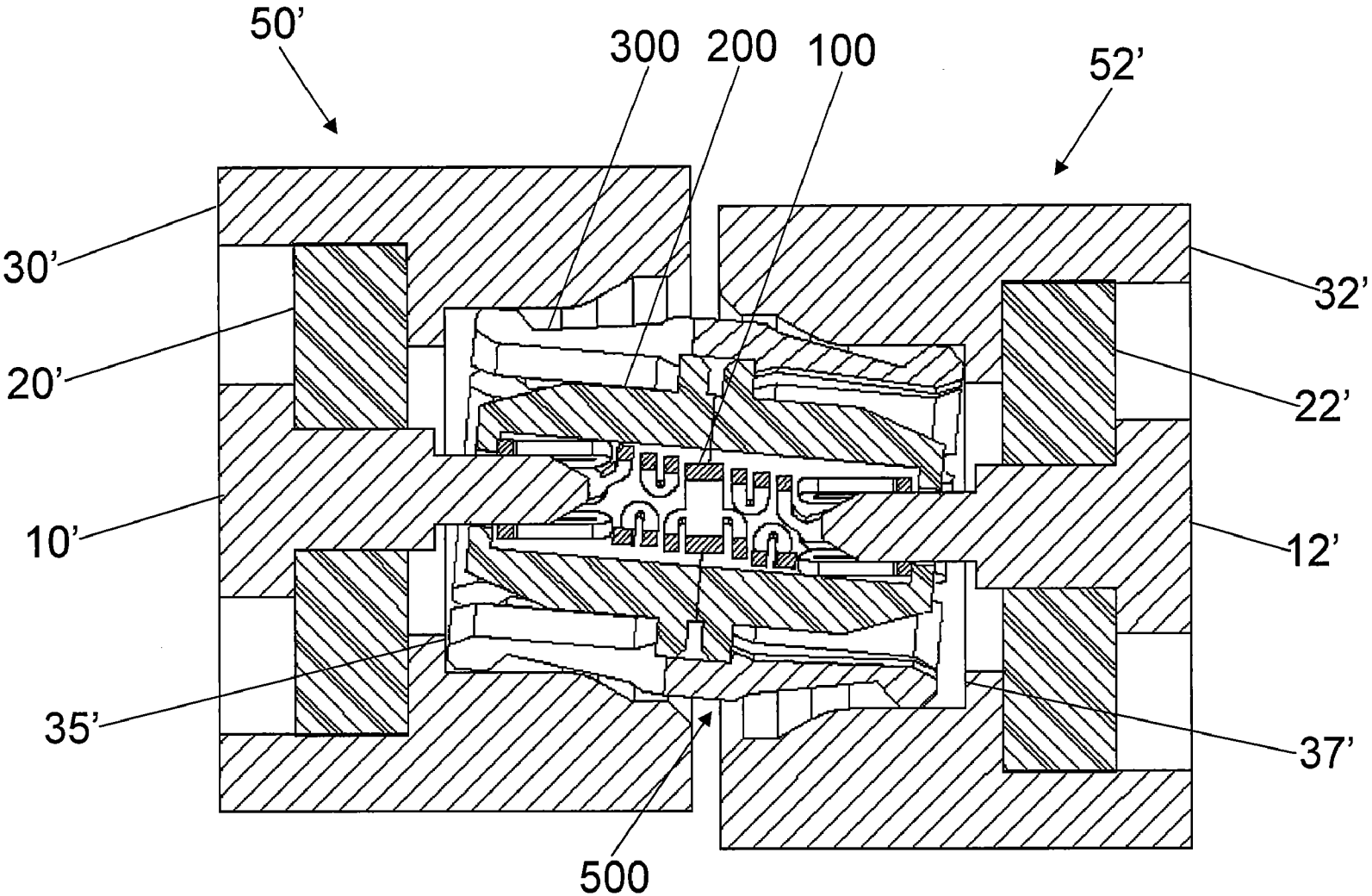
FIG. 7 illustrates a side cutaway view of the connector illustrated in FIG. 5 engaged with two non-coaxial male connectors.

FIG. 7 illustrates a side cutaway view of coaxial connector 500 illustrated in FIG. 5 engaged with two non-coaxial (misaligned) male connectors 50' and 52'. Male connector 50' acts as a coaxial transmission medium and includes a conductive outer housing (or shroud) 30' extending circumferentially about a longitudinal axis, an insulator 20' circumferentially surrounded by the conductive outer housing 30', and a conductive mating contact (male pin) 10' at least partially circumferentially surrounded by insulator 20'. Male connector 52' also acts as a coaxial transmission medium and includes a conductive outer housing (or shroud) 32' extending circumferentially about a longitudinal axis, an insulator 22' circumferentially surrounded by the conductive outer housing 32', and a conductive mating contact (male pin) 12' at least partially circumferentially surrounded by insulator 22'.

In the embodiment illustrated in FIG. 7, conductive outer housings 30' and 32' are electrically coupled to outer conductor portion 300 and mating contacts 10' and 12' are electrically coupled to socket contact 100. Conductive outer housings 30' and 32' each include reduced diameter portions 35' and 37', which each act as a mechanical stop or reference plane for first and second cantilevered beams 310 and 312 of outer conductor portion 300.

As is illustrated in FIG. 7, male connector 50' is not coaxial with male connector 52'. Socket contact 100 is adapted to flex axially, thereby allowing for mating misalignment (gimballing) between mating contact 10' and mating contact 12' (and hence mating misalignment (gimballing) between male connector 50' and male connector 52') while still maintaining radially inward biasing force of socket contact 100 on mating contacts 10' and 12', thereby facilitating transmission of an electrical signal between the socket contact 100 and the mating contacts 10' and 12' and also reducing the possibility of unwanted disengagement between the socket contact 100 and the mating contacts 10' and 12' during mated misalignment. In preferred embodiments, when mating contact 10' is not coaxial with mating contact 12', the entire inner surface of proximal portion 104 and the entire inner surface of distal portion 108 of socket contact 100 are adapted to contact the outer cylindrical surface of mating contacts 10' and 12' upon full engagement with mating contacts 10' and 12'. Preferably, socket contact 100 is adapted to allow for the longitudinal axis of mating contact 10' to be substantially parallel to the longitudinal axis of mating contact 12' (and hence the longitudinal axis of male connector 50' to be substantially parallel to the longitudinal axis of male connector 52') when mating contacts 10' and 12' (and hence male connectors 50' and 52') are not coaxial.

While FIGS. 5-7 show a double ended female interface configuration adapted to be mated with two male interfaces (as shown in FIGS. 6 and 7), other configurations include single ended variations where only the proximal end of the connector engages an interface with a male pin contact. The distal end of the connector can be soldered, brazed or crimped to a wire or soldered, brazed, or welded to another contact such as a socket/pin configuration.

Figure 8:
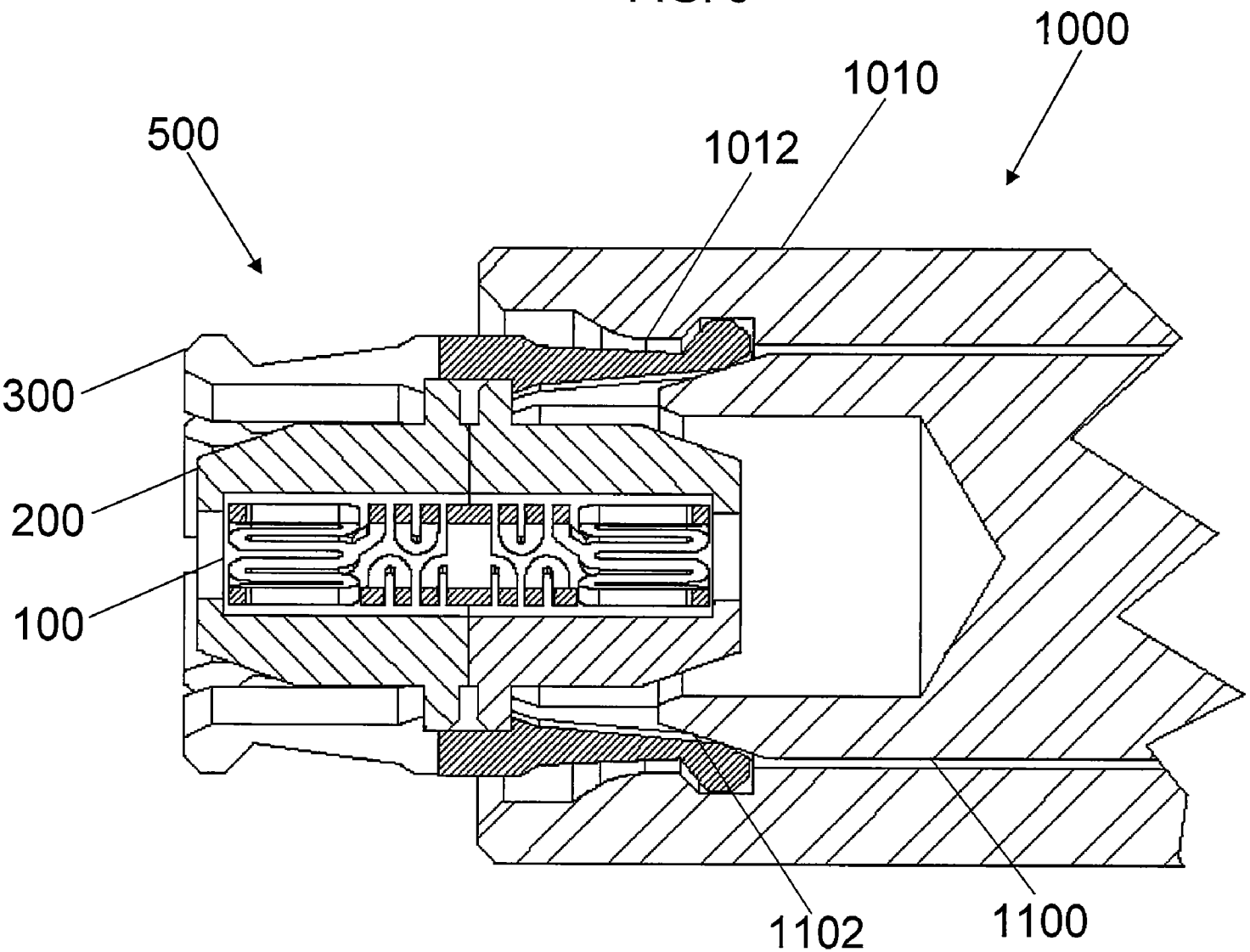
FIG. 8 illustrates a side cutaway view of the connector illustrated in FIG. 5 engaged with a mating/de-mating tool.

FIG. 8 illustrates a side cutaway view of coaxial connector 500 illustrated in FIG. 5 engaged with a mating/de-mating tool 1000. Mating/de-mating tool 1000 includes outer hollow cylindrical portion 1010 and inner cylindrical portion 1100. Outer hollow cylindrical portion 1010 includes detent feature 1012 that is adapted to engage external detent features 314 or 318 of first or second cantilevered beams 310 or 312 of outer conductor portion 300. Such engagement can be accomplished by sliding outer hollow cylindrical portion 1010 over first or second cantilevered beams 310 or 312. Next, inner cylindrical portion 1100 is slid inside first or second cantilevered beams 310 or 312 of outer conductor portion 300 such that at least a portion of ramped outer surface 1102 of inner cylindrical portion 1100 contacts at least a portion of an inside surface of first or second cantilevered beams 310 or 312. This restricts radial movement of cantilevered beams 310 or 312 and retains coaxial connector 500 in mating/de-mating tool 1000. During the mating or de-mating operation, outer hollow cylindrical portion 1010 and inner cylindrical portion 1100 are preferably held fixed relative to each other. When the mating or de-mating operation is complete, inner cylindrical portion 1100 can be retracted and the outer hollow cylindrical portion 1010 along with the entire mating/de-mating tool 1000 can be removed from coaxial connector 500.

Figure 9:
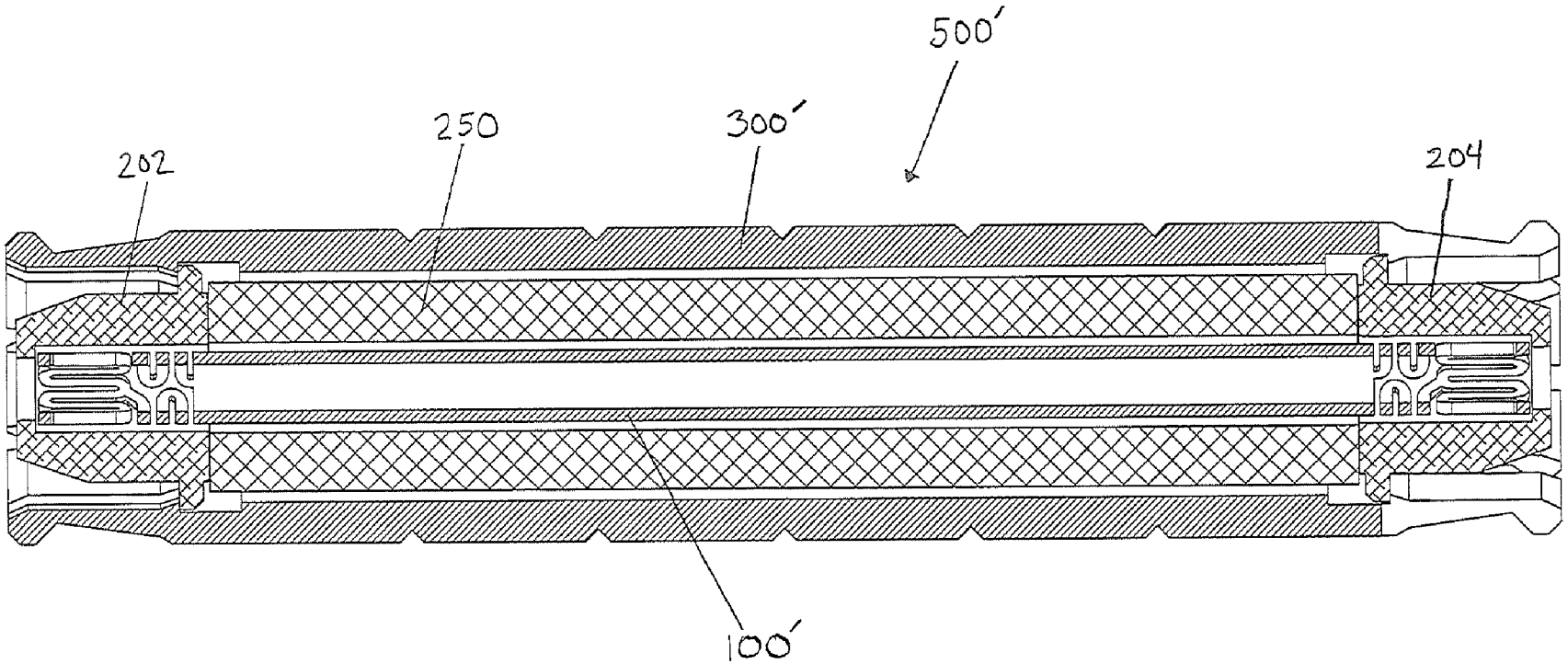
FIG. 9 illustrates a side cutaway view of another embodiment of a coaxial connector as disclosed herein.

FIG. 9 illustrates a side cutaway view of another embodiment of a coaxial connector 500'. Connector 500' is similar to the connector illustrated in FIG. 5, except connector 500' is longer and includes dielectric 250. Connector 500' includes outer conductor portion 300', first and second insulator components 202 and 204, and socket contact 100'. Socket contact 100' is similar to the socket contact illustrated in FIG. 5 except socket contact 100' has an elongated central portion. Outer conductor portion 300', first and second insulator components 202 and 204, and socket contact 100' can each be made with materials described above for analogous components of the connector illustrated in FIG. 5. Preferred materials for dielectric 250 include Ultem (polyetherimide), Torlon (Polyamide-imide) and Kapton (polyimide). Dielectric 250 can be machined from bar stock, molded, or made from extruded tubing. Preferably, dielectric 250 is made from extruded tubing.

Figure 10:
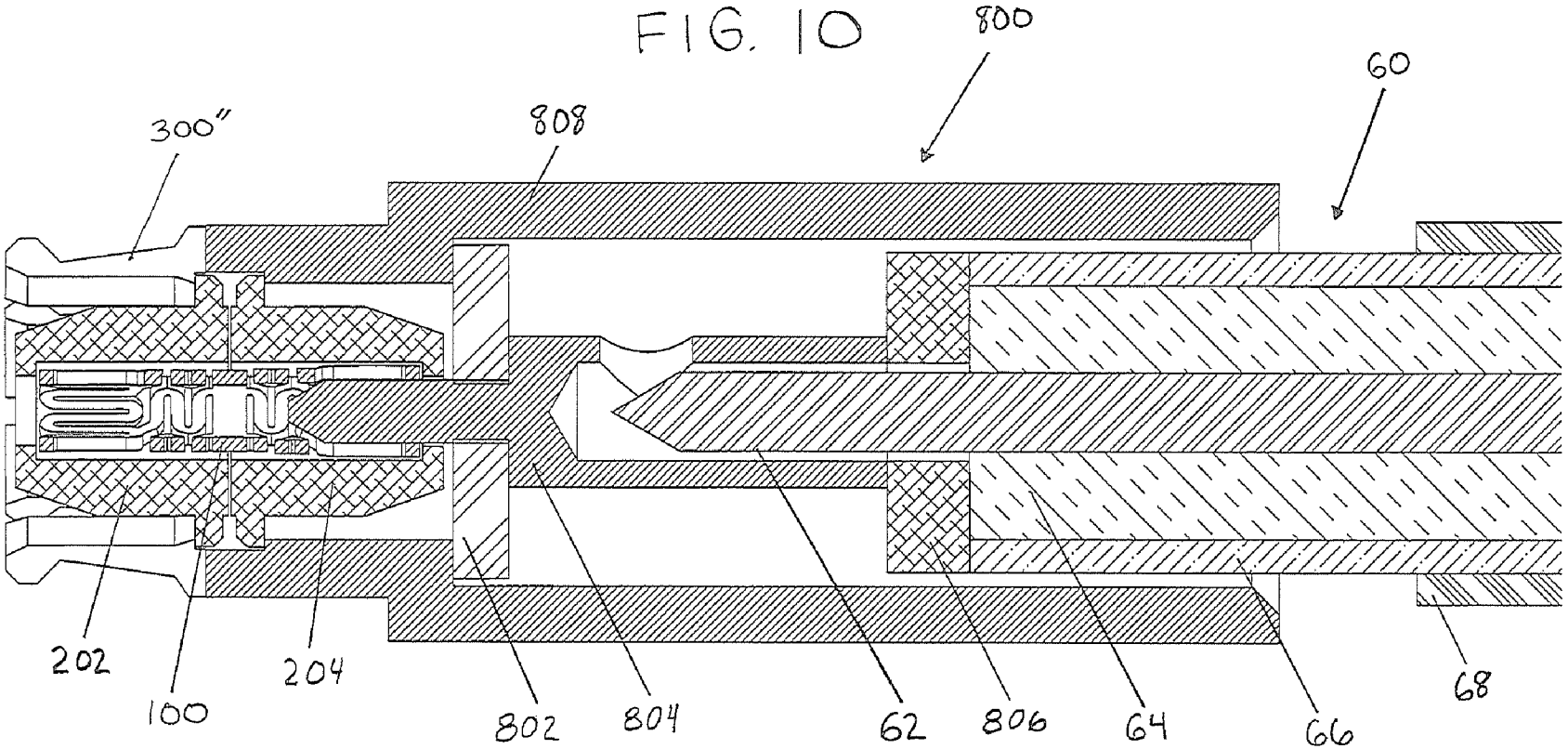
FIG. 10 illustrates a side cutaway view of a straight cable connector as disclosed herein mated with a coaxial cable.

FIG. 10 illustrates a side cutaway view of a straight cable connector 800 mated with a coaxial cable 60. Cable connector 800 includes an outer housing 808, at the front of which is outer conductor portion 300". Outer housing 808 and outer conductor portion 300" each extend substantially circumferentially around a first central bore in which first and second insulator components 202 and 204 are disposed. First and second insulator components 202 and 204 define a second central bore in which socket contact 100 is disposed. Cable connector further includes front insulator 802, center conductor contact 804, and back insulator 806. Coaxial cable 60 includes center conductor 62, insulator 64, outer conductor 66, and jacket 68.

Figure 11:
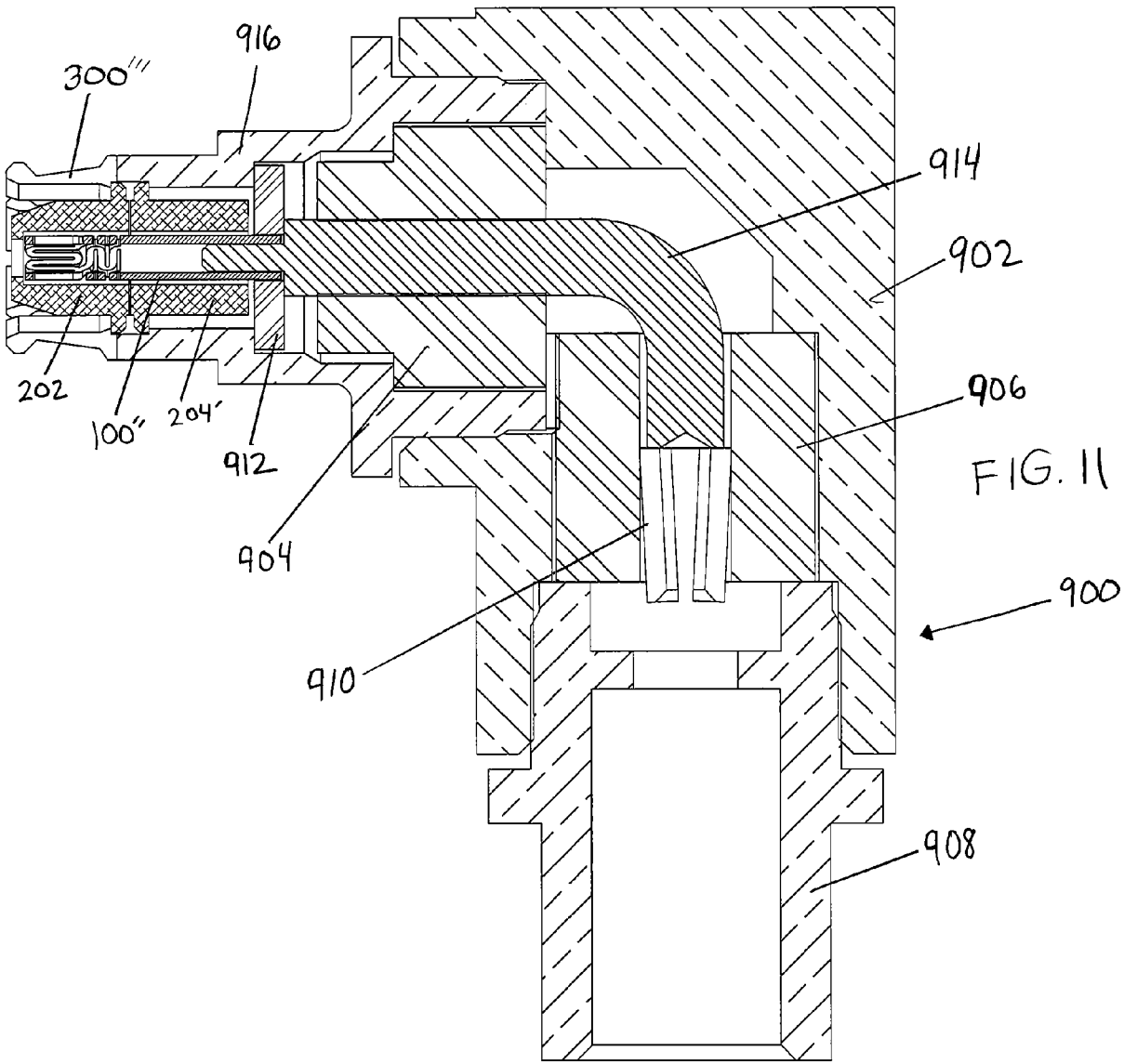
FIG. 11 illustrates a side cutaway view of an angled cable connector as disclosed herein.

FIG. 11 illustrates a side cutaway view of an angled cable connector 900. Angled cable connector 900 includes front housing 916, at the front of which is outer conductor portion 300'". Front housing 916 and outer conductor portion 300'" each extend substantially circumferentially around a first central bore in which first and second insulator components 202 and 204' are disposed. First and second insulator components 202 and 204' define a second central bore in which socket contact 100" is disposed. Socket contact 100" is similar to the socket contact illustrated in FIG. 5 except distal portion is not patterned to define a plurality of openings. Angled cable connector 900 further includes main body 902, angled center conductor contact 914, back housing 908, and first, second, and third insulators 912, 904, and 906. Socket contact 100" and angled center conductor contact 914 are preferably boded together via methods such as soldering, brazing, crimping, press fitting, or welding. In the embodiment illustrated in FIG. 11, angled center conductor contact 914 is configured to include a plurality of cantilevered tines 910 on its cable receiving end. While angled cable connector 900 is shown as a right angle connector (e.g., 90° angle connector), it should be understood that angled connectors having angles other than right angles (e.g., angles greater or less than)90° can also be employed.

Figure 12:
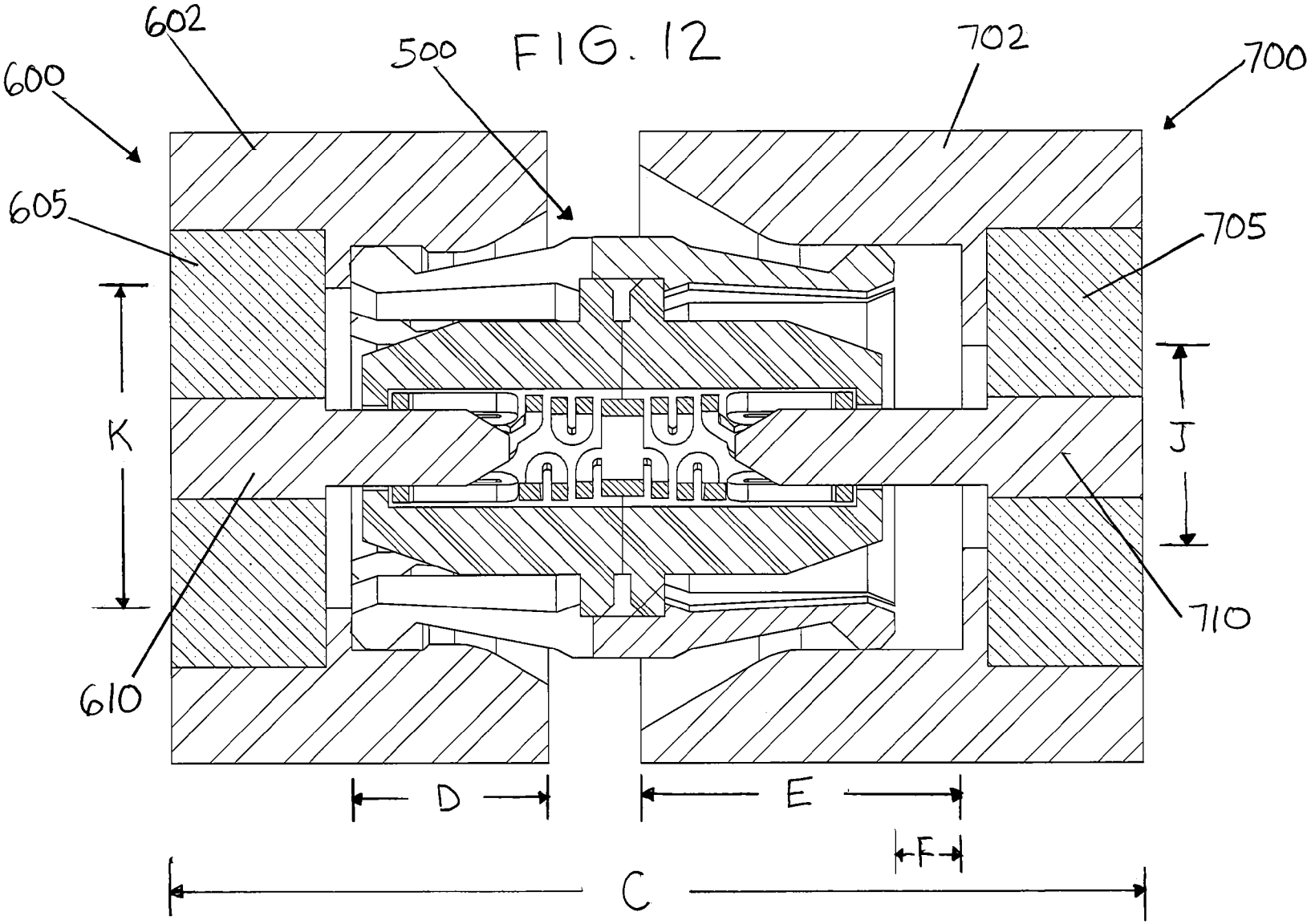
FIG. 12 illustrates a side cutaway view of the connector illustrated in FIG. 5 engaged with two male connectors having asymmetrical interfaces.

FIG. 12 illustrates a side cutaway view of the connector 500 illustrated in FIG. 5 engaged with first and second male connectors 600 and 700 having asymmetrical interfaces. First male connector 600 is a detented connector and includes a conductive outer housing (or shroud) 602 extending circumferentially about a longitudinal axis, an insulator 605 circumferentially surrounded by the conductive outer housing 602, and a conductive mating contact (male pin) 610 at least partially circumferentially surrounded by insulator 605. Second male connector 700 is a non-detented or smooth bore connector and also includes a conductive outer housing (or shroud) 702 extending circumferentially about a longitudinal axis, an insulator 705 circumferentially surrounding by the conductive outer housing 702, and a conductive mating contact (male pin) 710 at least partially circumferentially surrounded by insulator 705. As shown in FIG. 12, dimension D of first male connector 600 is smaller than dimension E of second male connector 700. The asymmetrical interfaces of first and second male connectors 600 and 700 allows for gap F to exist between the end of connector 500 and the reference plane of second male connector 700. This gap along with the longer dimension of E on second male connector 700 allows for dimension C to vary without having the connectors crash and break or become disconnected. Because of the allowance for gap F, diameter J is smaller than diameter K to electrically compensate for the highly inductive cavity caused by gap F. The embodiment illustrated in FIG. 12 can have particular applicability when working with smaller connectors and/or large variances is dimension C.

It will be apparent to those skilled in the art that various modifications and variations can be made without departing from the spirit and scope of the invention.

What is claimed is:

1. A coaxial connector contact for connecting to a coaxial transmission medium to form an electrically conductive path between the transmission medium and the coaxial connector contact, the coaxial connector contact comprising:

a main body comprising a proximal portion and a distal portion, a first end and an opposing second end, the first end disposed on the proximal portion and the second end disposed on the distal portion;

wherein along the proximal portion, the main body comprises electrically conductive material that extends circumferentially about a longitudinal axis said electrically conductive material having an inner surface and an outer surface, wherein said electrically conductive material is patterned to define a plurality of openings extending between the inner and outer surfaces along a longitudinal length of the proximal portion, at least one of said openings extending from the first end and at least one other of said openings not extending to the first end, wherein said plurality of openings comprise u-shaped slots, said u-shaped slots alternating in opposing orientations such that said electrically conductive material circumferentially extends around said longitudinal axis in an axially parallel accordion pattern.

2. The coaxial connector contact of claim 1, wherein along the distal portion, the main body comprises electrically conductive material that extends circumferentially about a longitudinal axis said electrically conductive material having an inner surface and an outer surface, wherein said electrically conductive material is patterned to define a plurality of openings extending between the inner and outer surfaces along a longitudinal length of the distal portion, at least one of said openings extending from the second end and at least one other of said openings not extending to the second end.

3. The coaxial connector contact of claim 2, wherein the inner surface of the proximal portion and the inner surface of the distal portion are each adapted to circumferentially engage an outer surface of a mating contact, wherein engagement of the inner surface of said proximal portion and said distal portion with said outer surface causes said proximal portion and said distal portion to flex radially outwardly.

4. The coaxial connector contact of claim 3, wherein upon said engagement, the entire inner surface of the proximal portion and the entire inner surface of the distal portion are adapted to contact said outer surface.

5. The coaxial connector contact of claim 4, wherein upon said engagement, the mating contact circumferentially engaged by the proximal portion is not coaxial with the mating contact circumferentially engaged by the distal portion.

6. The coaxial connector contact of claim 1, wherein the main body further comprises a central portion between the proximal portion and the distal portion, wherein along the central portion, the main body comprises electrically conductive material that extends circumferentially about a longitudinal axis said electrically conductive material having an inner surface and an outer surface, wherein said electrically conductive material is patterned to define a plurality of openings extending between the inner and outer surfaces at least partially circumferentially around said central portion.

7. The coaxial connector contact of claim 6, wherein said plurality of openings extending at least partially circumferentially around said central portion comprise u-shaped slots.

8. The coaxial connector contact of claim 6, wherein said plurality of openings extending along the longitudinal length of the proximal portion comprise first u-shaped slots and said plurality of openings extending at least partially circumferentially around said central portion comprise second u-shaped slots that are generally perpendicular to the first u-shaped slots.

9. The coaxial connector contact of claim 1, wherein the main body is of unitary construction.

10. A coaxial connector for connecting to a coaxial transmission medium to form an electrically conductive path between the transmission medium and the coaxial connector, the coaxial connector comprising:

an outer conductor portion for electrically coupling to an outer conductor of the coaxial transmission medium, the outer conductor portion extending substantially circumferentially about a longitudinal axis and defining a first central bore;

an insulator disposed within the first central bore and extending at least partially about the longitudinal axis and defining a second central bore; and and a coaxial connector contact at least partially disposed within the second central bore;

wherein the coaxial connector contact comprises:

a main body comprising a proximal portion and a distal portion, a first end and an opposing second end, the first end disposed on the proximal portion and the second end disposed on the distal portion;

wherein along the proximal portion, the main body comprises electrically conductive material that extends circumferentially about a longitudinal axis said electrically conductive material having an inner surface and an outer surface, wherein said electrically conductive material is patterned to define a plurality of openings extending between the inner and outer surfaces along a longitudinal length of the proximal portion, at least one of said openings extending from the first end and at least one other of said openings not extending to the first end, wherein said plurality of openings comprise u-shaped slots, said u-shaped slots alternating in opposing orientations such that said electrically conductive material circumferentially extends around said longitudinal axis in an axially parallel accordion pattern.

11. The coaxial connector of claim 10, wherein along the distal portion of the coaxial connector contact, the main body comprises electrically conductive material that extends circumferentially about a longitudinal axis said electrically conductive material having an inner surface and an outer surface, wherein said electrically conductive material is patterned to define a plurality of openings extending between the inner and outer surfaces along a longitudinal length of the distal portion, at least one of said openings extending from the second end and at least one other of said openings not extending to the second end.

12. The coaxial connector of claim 11, wherein the inner surface of the proximal portion and the inner surface of the distal portion of the coaxial connector contact are each adapted to circumferentially engage an outer surface of a mating contact, wherein engagement of the inner surface of said proximal portion and said distal portion with said outer surface causes said proximal portion and said distal portion to flex radially outwardly.

13. The coaxial connector of claim 12, wherein upon said engagement, the entire inner surface of the proximal portion and the entire inner surface of the distal portion of the coaxial connector contact are adapted to contact said outer surface.

14. The coaxial connector of claim 13, wherein upon said engagement, the mating contact circumferentially engaged by the proximal portion is not coaxial with the mating contact circumferentially engaged by the distal portion.

15. The coaxial connector of claim 10, wherein the main body of the coaxial connector contact further comprises a central portion between the proximal portion and the distal portion, wherein along the central portion, the main body comprises electrically conductive material that extends circumferentially about a longitudinal axis said electrically conductive material having an inner surface and an outer surface, wherein said electrically conductive material is patterned to define a plurality of openings extending between the inner and outer surfaces at least partially circumferentially around said central portion.

16. The coaxial connector of claim 10, wherein the coaxial connector is a straight cable connector.

17. The coaxial connector of claim 10, wherein the coaxial connector is an angled cable connector.

18. A coaxial transmission medium assembly comprising:

a coaxial transmission medium comprising:

a conductive outer housing extending circumferentially about a longitudinal axis;

an insulator circumferentially surrounded by the conductive outer housing; and a conductive mating contact at least partially circumferentially surrounded by the insulator; and a coaxial connector for connecting to the coaxial transmission medium to form an electrically conductive path between the transmission medium and the coaxial connector, the coaxial connector comprising:

an outer conductor portion for electrically coupling to an outer conductor of the coaxial transmission medium, the outer conductor portion extending substantially circumferentially about a longitudinal axis and defining a first central bore;

an insulator disposed within the first central bore and extending at least partially about the longitudinal axis and defining a second central bore; and a coaxial connector contact at least partially disposed within the second central bore;

wherein the coaxial connector contact comprises:

a main body comprising a proximal portion and a distal portion, a first end and an opposing second end, the first end disposed on the proximal portion and the second end disposed on the distal portion;

wherein along the proximal portion, the main body comprises electrically conductive material that extends circumferentially about a longitudinal axis said electrically conductive material having an inner surface and an outer surface, wherein said electrically conductive material is patterned to define a plurality of openings extending between the inner and outer surfaces along a longitudinal length of the proximal portion, at least one of said openings extending from the first end and at least one other of said openings not extending to the first end, wherein said plurality of openings comprise u-shaped slots, said u-shaped slots alternating in opposing orientations such that said electrically conductive material circumferentially extends around said longitudinal axis in an axially parallel accordion pattern; and wherein the conductive outer housing is electrically coupled to the outer conductor portion and the conductive mating contact is electrically coupled to the coaxial connector contact.

19. The coaxial transmission medium assembly of claim 18, wherein said coaxial transmission medium is a first coaxial transmission medium and the coaxial transmission medium assembly further comprises a second coaxial transmission medium comprising:

a conductive outer housing extending circumferentially about a longitudinal axis;

an insulator circumferentially surrounded by the conductive outer housing; and a conductive mating contact at least partially circumferentially surrounded by the insulator;

wherein the conductive outer housing of the second coaxial transmission medium is electrically coupled to the outer conductor portion and the conductive mating contact of the second coaxial transmission medium is electrically coupled to the coaxial connector contact; and wherein the first coaxial transmission medium has a detented bore and the second coaxial transmission medium has a smooth bore.

20. The coaxial transmission medium assembly of claim 18, wherein the main body of the coaxial connector contact further comprises a central portion between the proximal portion and the distal portion, wherein along the central portion, the main body comprises electrically conductive material that extends circumferentially about a longitudinal axis said electrically conductive material having an inner surface and an outer surface, wherein said electrically conductive material is patterned to define a plurality of openings extending between the inner and outer surfaces at least partially circumferentially around said central portion.

21. The coaxial transmission medium assembly of claim 20, wherein said plurality of openings of the coaxial connector contact extending at least partially circumferentially around said central portion comprise u-shaped slots.

22. The coaxial transmission medium assembly of claim 20, wherein said plurality of openings of the coaxial connector contact extending along the longitudinal length of the proximal portion comprise first u-shaped slots and said plurality of openings of the coaxial connector contact extending at least partially circumferentially around said central portion comprise second u-shaped slots that are generally perpendicular to the first u-shaped slots.

* * * * *